United States Patent [19]

Bull et al.

[11] Patent Number: 4,940,233

[45] Date of Patent: Jul. 10, 1990

[54] AEROBIC CONDITIONING APPARATUS

[76] Inventors: John Bull, 2 Viento, Irvine, Calif. 92720; Ian Fettes, 1001 W. 17th St., Costa Mesa, Calif. 92627; Harry Purcell, 832 Alesenandro Ave., La Verne, Calif. 91570

[21] Appl. No.: 158,260

[22] Filed: Feb. 19, 1988

[51] Int. Cl.[5] ..... A63B 21/008

[52] U.S. Cl. ..... 272/130; 272/70; 272/97; 272/134

[58] Field of Search ..... 272/70, 71, 72, 97, 272/125, 126, 130, 131, 132, 134; 128/25 R

[56] References Cited

U.S. PATENT DOCUMENTS

| | | | |
|---|---|---|---|
| 219,439 | 9/1879 | Blend | 272/70 X |
| 326,247 | 9/1885 | Root | 128/25 R |
| 2,079,594 | 5/1937 | Clem | 272/70 X |
| 2,405,024 | 7/1946 | Eynon | 272/134 X |
| 3,747,924 | 7/1973 | Champoux | 272/70 |
| 3,759,511 | 9/1973 | Zinkin et al. | 272/132 X |
| 3,970,302 | 7/1976 | McFee | 272/130 |
| 4,512,571 | 4/1985 | Hermelin | 272/126 |
| 4,529,194 | 7/1985 | Haaheim | 272/70 X |
| 4,563,001 | 1/1986 | Terauds | 272/130 X |
| 4,645,197 | 2/1987 | McFee | 272/130 X |
| 4,645,200 | 2/1987 | Hix | 272/70 X |
| 4,681,316 | 7/1987 | DeCloux | 272/130 |
| 4,684,126 | 8/1987 | Dalebout et al. | 272/132 X |
| 4,850,585 | 7/1989 | Daleboot | 272/70 |

FOREIGN PATENT DOCUMENTS

| | | | |
|---|---|---|---|
| 45140 | 11/1888 | Fed. Rep. of Germany | 272/70 |
| 2416778 | 10/1974 | Fed. Rep. of Germany | 272/70 |

*Primary Examiner*—Robert D. Bahr

*Attorney, Agent, or Firm*—James E. Brunton

[57] ABSTRACT

An aerobic conditioning apparatus for use by a trainee in simultaneously exercising the upper and lower body in a smooth shock-free manner substantially simulating movement of the arms and legs during swimming. The apparatus includes a supporting frame, first and second foot supporting assemblies mounted on the supporting frame for controlling the movement of the right and left feet of the user respectively to an oscillatory motion along first and second paths between first forward positions and a second rearward position, first and second hand engaging assemblies mounted on the supporting frame for controlling the movement of the right and left hands of the user respectively to an oscillatory motion along paths between a first upraised position and a second lowered position, and synchronizing mechanisms mounted on the supporting frame for causing synchronous movement of the foot engaging assemblies and the hand engaging assemblies.

3 Claims, 8 Drawing Sheets

33
20
36
106
31
118
120
96b
107
114
96
33
68
90
92
68
19
16
98

A
24
20
38
120
118
120
106
24
116
96b
107
114
31
B
36
110
96
33
12
96a
V
94
40
90
92
22
98
68
22
A
69
64
B
19
68
16
56
50
64
54
64
54
54
70
76
14

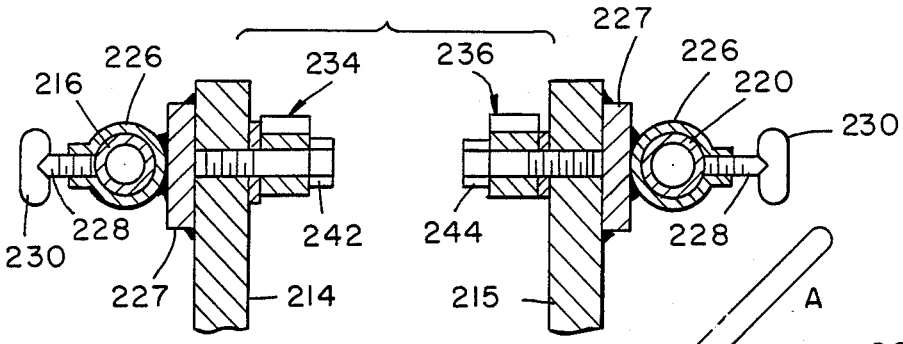
FIG. 18
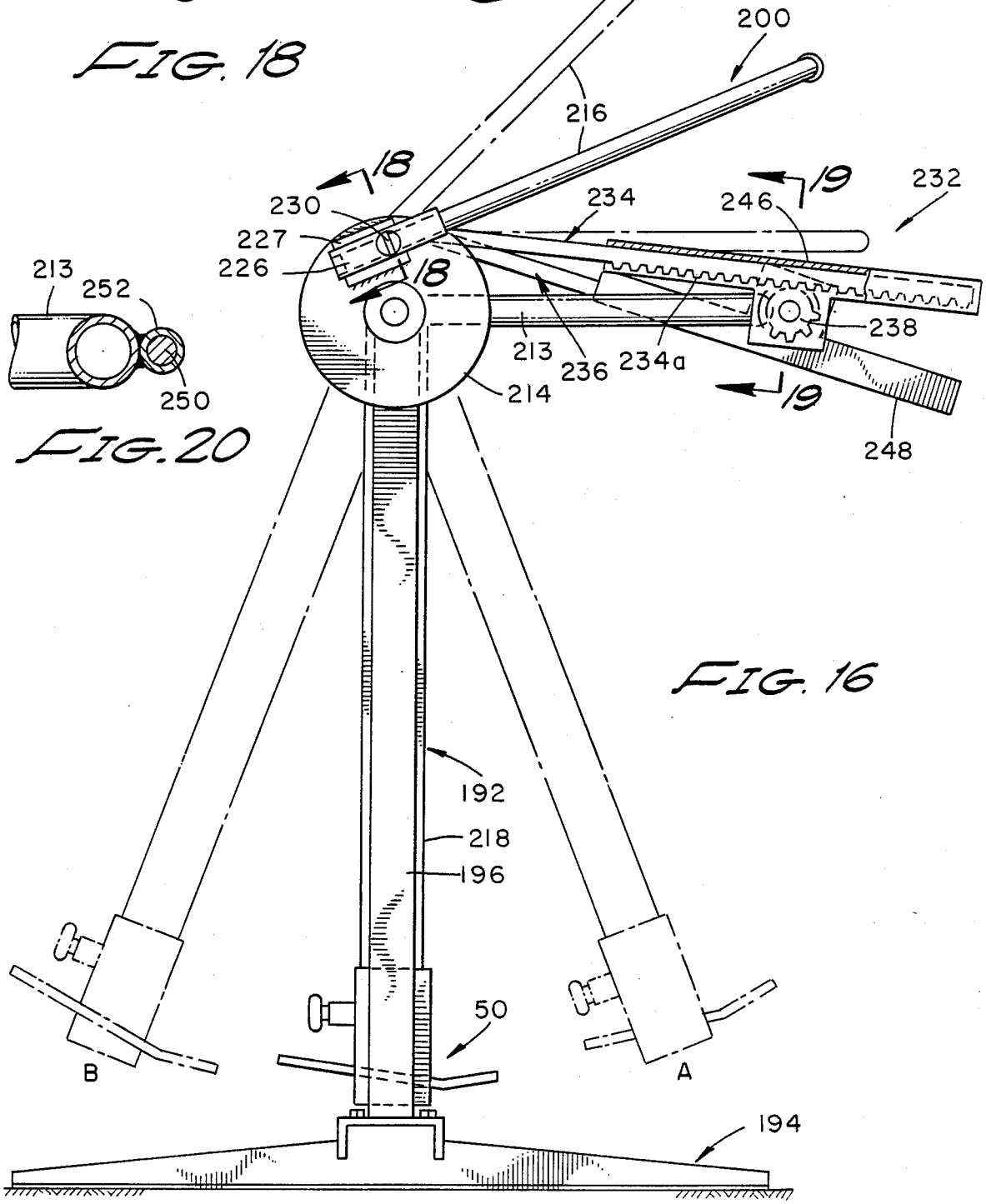
FIG. 20
FIG. 16

AEROBIC CONDITIONING APPARATUS

BACKGROUND OF THE INVENTION

1. Field of the Invention

The present invention relates generally to exercise equipment. More particularly, the invention concerns an aerobic conditioning apparatus for exercising the upper and lower body simultaneously.

2. Discussion of the Invention

In recent years aerobic conditioning has become increasingly popular. Many people have turned to jogging and walking to provide daily exercise. Additionally, many people have joined clubs or organized groups offering supervised aerobic exercises.

As jogging has become more popular, impact related injuries to the back, legs, feet and joints have increased. To a lesser extent regular walking has also contributed to these types of injuries. Those active in sports medicine now generally agree that long-term jogging and walking, particularly in urban areas and without proper equipment can result in serious debilitating injuries.

In addition to jogging and walking, tennis, handball, squash and similar sports have been a popular form of exercise particularly for the legs and lower body. However, these sports can also cause serious bodily injury. Further such sports require special facilities and are generally weather controlled.

In an attempt to overcome the drawbacks of jogging, many manufacturers are offering elaborate types of treadmill-type apparatus. Such apparatus basically exercises only the lower body and is typically quite expensive and often cumbersome to use. Maintenance costs for such equipment can be high and considerable space is often required for the equipment. Further, treadmill apparatus can be dangerous to use and falls can occur with treadmills. Swimming has long been a popular form of full-body exercise and is generally considered safer and far more beneficial than jogging, tennis or handball. However, once again, costly, special facilities are required and, in many parts of the country, private swimming pools are impractical due to weather considerations.

The apparatus of the present invention uniquely overcomes the disadvantages of jogging and related exercises as set forth in the preceding paragraphs by providing a device which simultaneously exercises the upper and lower body in a safe and comfortable manner. The apparatus simulates, to a high degree, the beneficial type of exercise received by swimming. The arms and legs are effectively exercised in a smooth impact-free environment with a minimum risk of injury. The device is easy to use, even by the novice, and is highly reliable and virtually maintenance free. The apparatus requires a relatively small space so that it can be used indoors or out and it is quite inexpensive to manufacture and maintain.

SUMMARY OF THE INVENTION

It is an object of the present invention to provide an aerobic conditioning apparatus which can be used to simultaneously exercise the upper and lower body.

It is another object of the invention to provide an apparatus of the aforementioned character which is safe to use even by the novice.

Another object of the invention is to provide an apparatus of the type described in the preceding paragraphs in which the exercise is performed efficiently in a smooth, shock-free manner with minimum impact stress being exerted on the muscles and joints of the body of the user.

Another object of the invention is to provide an aerobic conditioning apparatus which is compact, is of simple design and one which is highly reliable in use.

Still another object of the invention is to provide an apparatus of the class described in which the degree of resistance to the simultaneous movement of the arms and legs of the trainee can be quickly and easily regulated.

Yet another object of the invention is to provide an apparatus of the character previously described in which the components thereof are readily adjustable to accommodate trainees of differing stature.

A further object of the invention is to provide an apparatus as described in the preceding paragraphs which will conform to conventional methods of manufacture, is of simple construction and one which can be inexpensively manufactured and sold.

BRIEF DESCRIPTION OF THE DRAWINGS

FIG. 16 is an end view of another alternate form of the Aerobic Conditioning Apparatus of the Invention.

FIG. 18 is a cross-sectional view taken along lines 18—18 of FIG. 16.

FIG. 20 is a cross-sectional view taken along lines 20—20 of FIG. 19.

DISCUSSION OF THE INVENTION

Figures 1, 11:
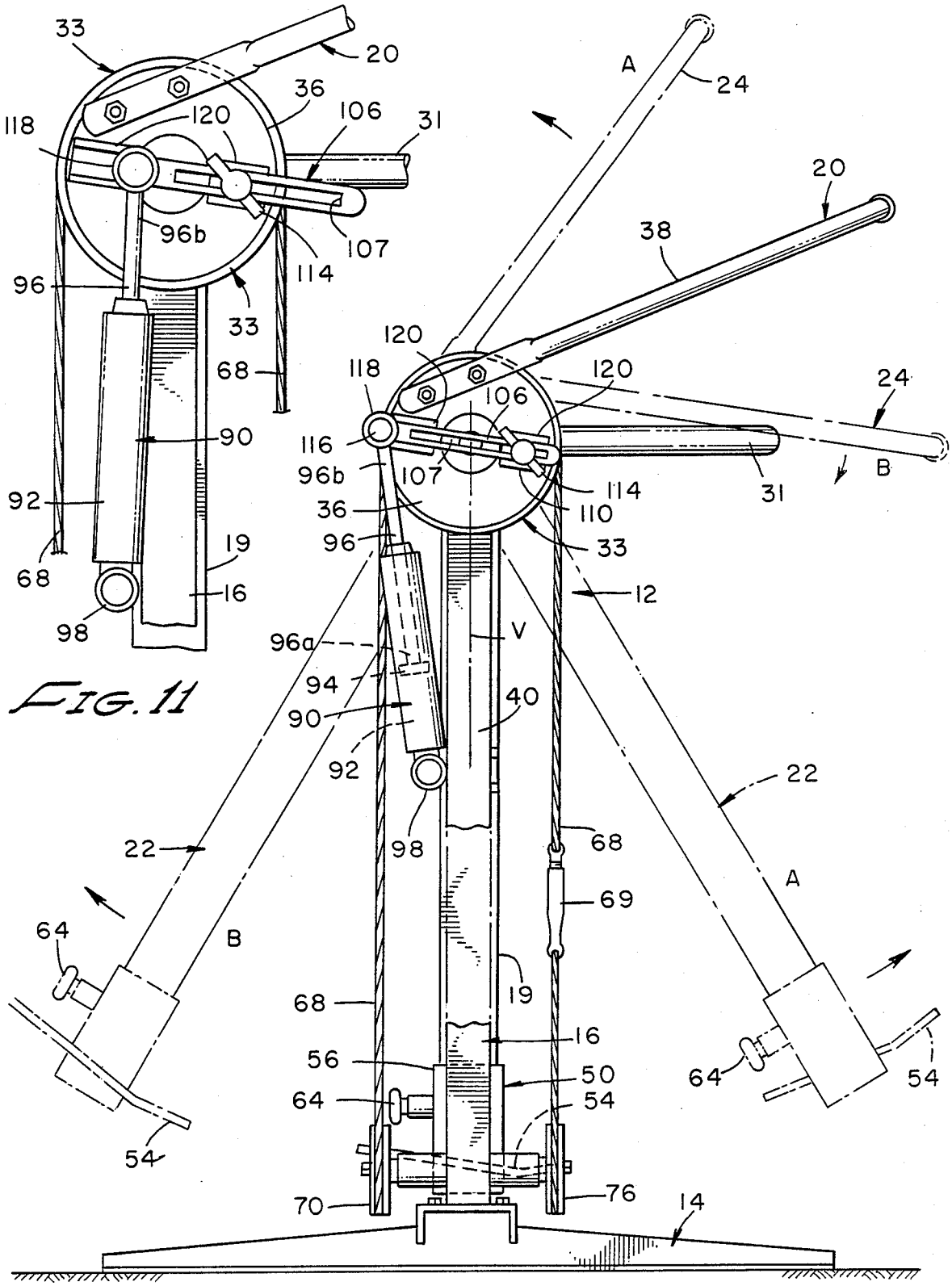
FIG. 1 is an end view of the Aerobic Conditioning Apparatus of the invention.
FIG. 11 is a fragmentary, side view similar to FIG. 9, showing the method of adjustment of the resistance means of the apparatus of the invention.
Figure 2:
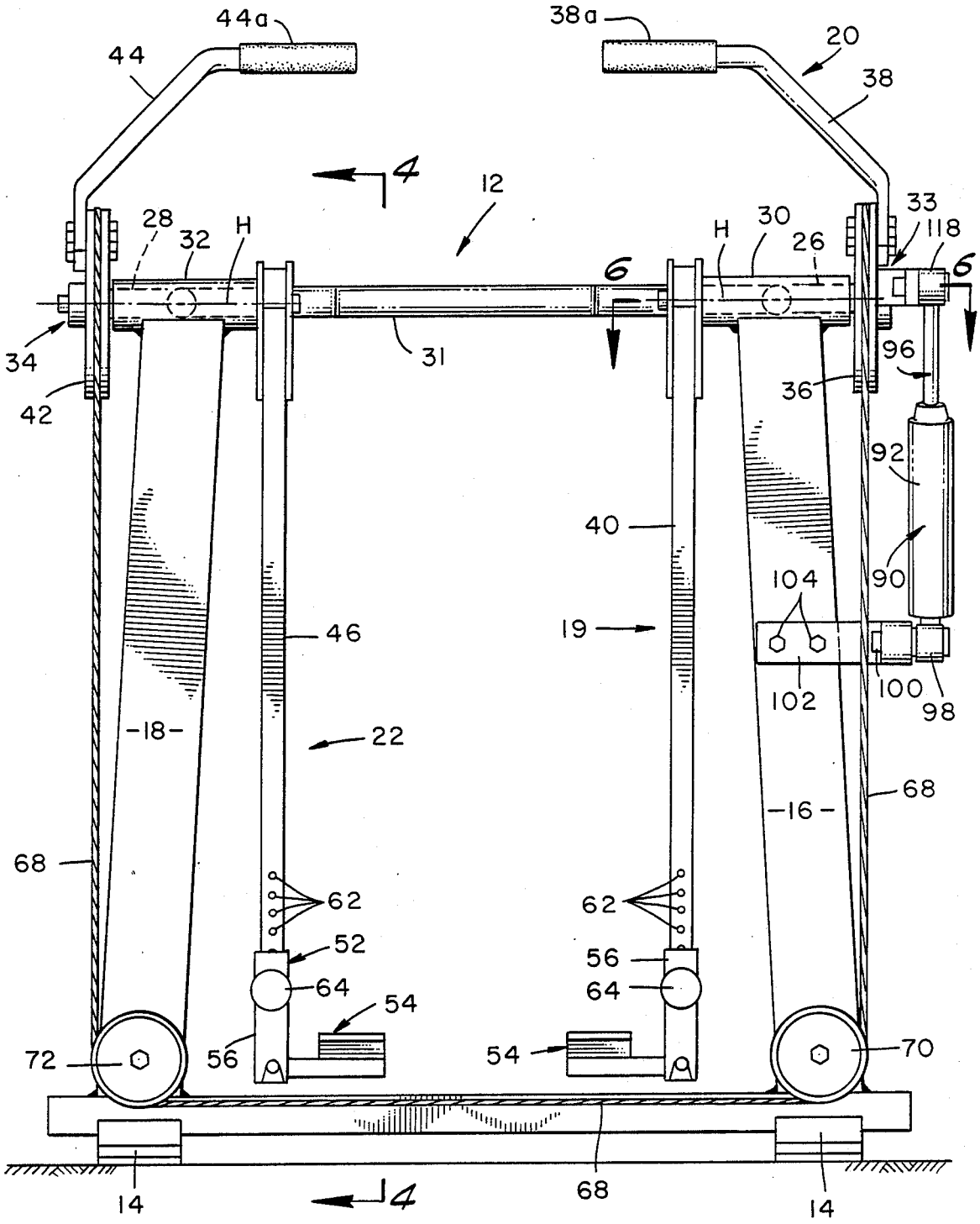
FIG. 2 is an elevational view of the apparatus, viewed from the left of FIG. 1.
Figure 3:
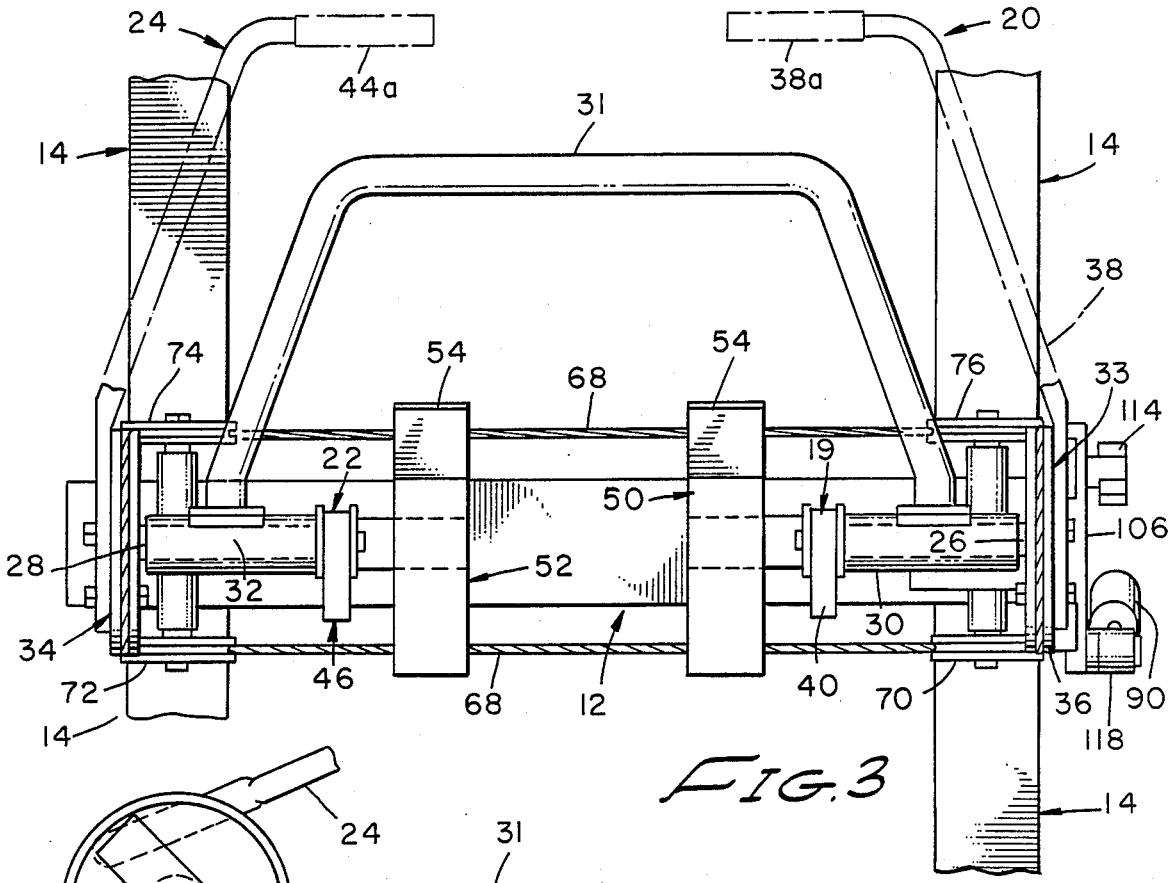
FIG. 3 is a fragmentary top view of the apparatus of the invention.
Figure 4:
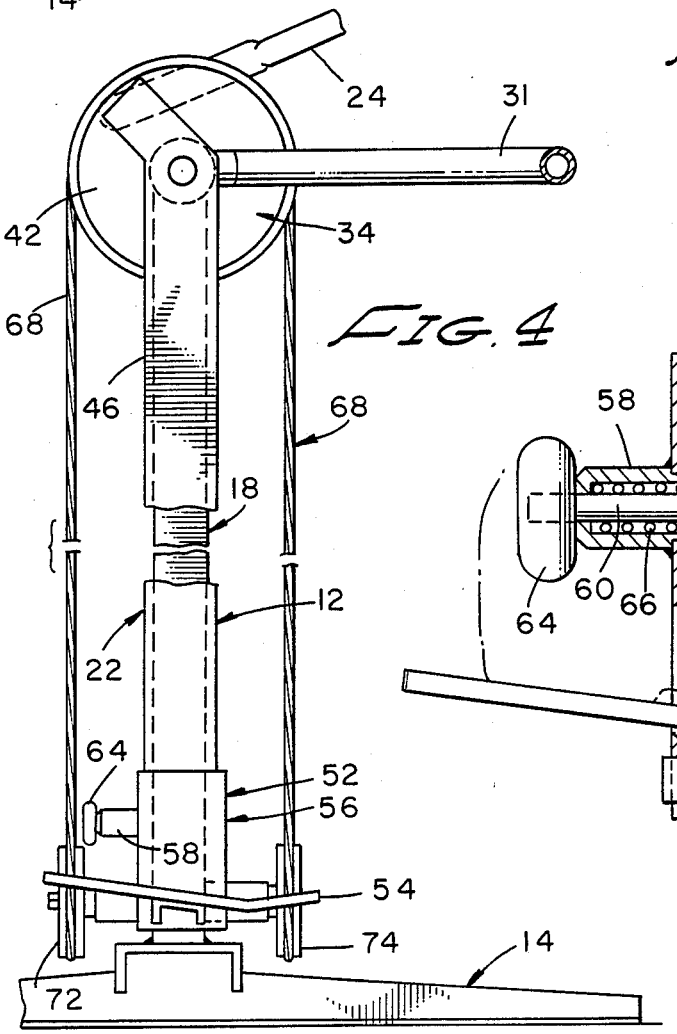
FIG. 4 is a foreshortened view taken along lines 4—4 of FIG. 2.

Referring to the drawings and particularly to FIGS. 1, 2, and 3, one form of the aerobic exercising apparatus of the present invention is there shown. The apparatus comprises a supporting frame 12 having a base 14 and first and second transversely spaced vertical uprights 16 and 18 (FIG. 2) mounted on base 14. Carried by the supporting frame 12 are first and second foot engaging means and first and second hand engaging means for engagement by the user during the performance of exercises on the apparatus.

As best seen by referring to FIGS. 1 and 2, the first foot engaging means, generally designated by the numeral 19, restricts the movement of the right foot of the user to an oscillatory motion along a first arcuate path between a first forward position and a second rearward position. The first hand engaging means, generally designated by the numeral 20, restricts the movement of the right hand of the user to an oscillatory motion along a second generally arcuate path between a first upraised position and a second lowered position. The oscillatory movement of the right hand and right foot is constrained by the apparatus within generally vertically extending substantially parallel planes extending perpendicular to the plane of the paper as the apparatus if viewed in FIG. 2.

The second foot engaging means, generally designated in FIG. 2 by the numeral 22, restricts the movement of the left foot of the user to an oscillatory motion along a third arcuate path between a first forward position A and a second rearward position B. (See the phantom lines in FIG. 1) Similarly, the second hand engaging means, generally designated in FIG. 2 by the numeral 24, restricts the oscillatory movement of the left hand of the user to an oscillatory motion along a fourth generally arcuate path between a first upraised position A and a second lowered position B. Once again the oscillatory movement of the left hand and left foot is constrained by the apparatus within generally vertically extending substantially parallel planes. These planes are also substantially parallel to the planes of movement of the right hand and right foot of the unit. As will be discussed in greater detail hereinafter, the first foot and hand engaging means are out of phase with the second foot and hand engaging means so that when the user's right foot is forward, the left foot is rearward. Similarly, when the right hand is raised, the left hand is in the lowered position.

Forming an important feature of the aerobic exercising apparatus of the invention is synchronizing means for insuring synchronous movement of the first foot engaging means and first hand engaging means with the second foot engaging means and the second engaging means during the performance of exercises using the apparatus. The details of construction of this synchronizing means will presently be described.

Figure 6:
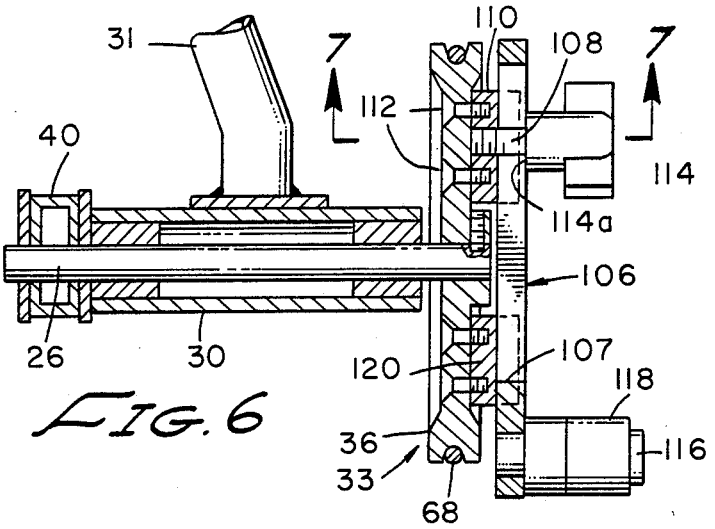
FIG. 6 is an enlarged fragmentary cross-sectional view taken along line 6—6 of FIG. 2.

Turning now to FIGS. 2 and 6, first and second axles 26 and 28 are rotatably carried by first and second bearing assemblies 30 and 32 respectively. Bearing assemblies 30 and 32 are mounted on vertical uprights 16 and 18 respectively proximate the upper ends thereof and in the manner shown in FIG. 2. The axis of rotation of the axles is generally horizontal and is defined by the intersection of a vertical plane generally indicated as "V" in FIG. 1 and a horizontal plane generally designated as "H" in FIG. 2. As best seen in FIG. 3, a generally U shaped forwardly extending support bar 31 is interconnected at its ends with bearing assemblies 30 and 32. Affixed proximate one end of axles 26 and 28 for rotation therewith are first and second pulley assemblies 33 and 34. The first pulley assembly 33, shown at the upper right hand portion of FIG. 2, comprises a pulley 36 and an elongated upwardly extending member 38. Member 38 forms a part of the previously identified first hand engaging means 20. Affixed at the other end of axle 26 is a downwardly extending member 40. Member 40 forms a part of the previously identified first foot engaging means 19 of the invention.

The second pulley assembly 34, shown at the upper left portion of FIG. 2, is of similar construction and includes a pulley 42 and an elongated upwardly extending member 44. Member 44 forms a part of the previously identified second hand engaging means 24 of the invention. Affixed at the other end of axle 28 is a downwardly extending member 46. Member 46 forms a part of the previously identified second foot engaging means 22 of the invention.

Figure 5:
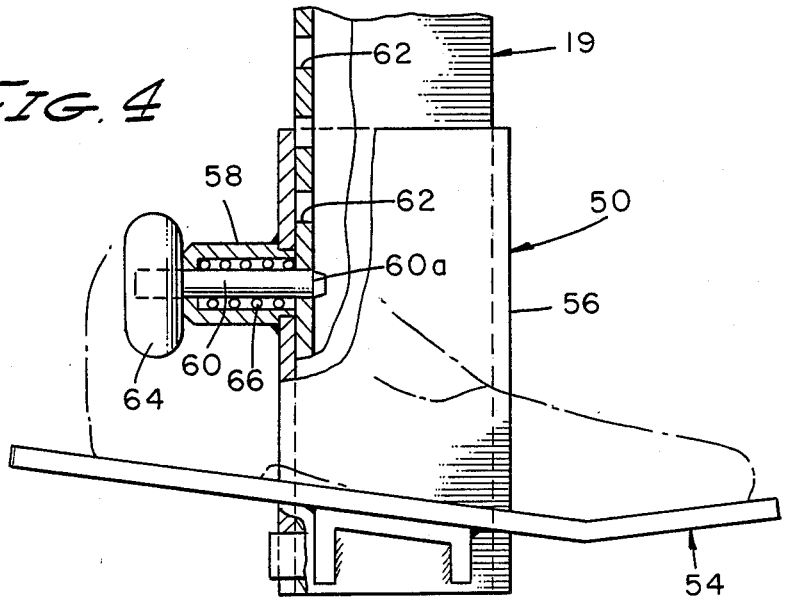
FIG. 5 is an enlarged fragmentary, side elevational view partly in section of the adjustable foot plate of the invention.

A foot support assembly 50 is adjustably connected to member 40 and a foot support assembly 52 is adjustably connected to member 46. As best seen by referring to FIGS. 2 and 5, foot support assemblies 50 and 52 each include a foot engaging plate 54 and a tubular sleeve member 56 to which the foot plate 54 is interconnected. A spring loaded locking pin assembly 58 (FIG. 5) is connected to each sleeve 56 and includes a locking pin 60, the inner end 60A of which is closely receivable within a selected one of the vertically spaced apart apertures 62 provided in members 40 and 46. A handle portion 64 is provided on each locking pin 60 so that the locking pin can be withdrawn, against the urging of a coiled spring 66, to a position wherein end 60A of the locking pin clears the aperture 62 provided in the downwardly depending members of the first and second foot engaging means. In this way, the foot support assemblies of the invention can be raised and lowered with respect to downwardly depending members 40 and 46 so as to accommodate users of various stature.

Considering now the previously identified synchronizing means of the invention, this means functions to operatively interconnect the first hand and foot engaging means with the second hand and foot engaging means of the invention so that, for example, when the right foot of the user is in the first forward position, and the left foot of the user is in the rearward position, the right hand is in the first upraised position, and the left hand is in the second lowered position. By synchronizing this oscillatory motion in the manner indicated by phantom lines in FIG. the movement of the arms and legs of the user closely simulates the movement of the arms and legs during a standard crawl-type swimming stroke. It is to be noted that, as shown in FIG. 1, when the foot engaging means 19 is disposed vertically, the hand engaging means 20 extends angularly upwardly relative to horizontal. This angle relative to horizontal is preferably between about 15 and 30 degrees.

Figure 10:
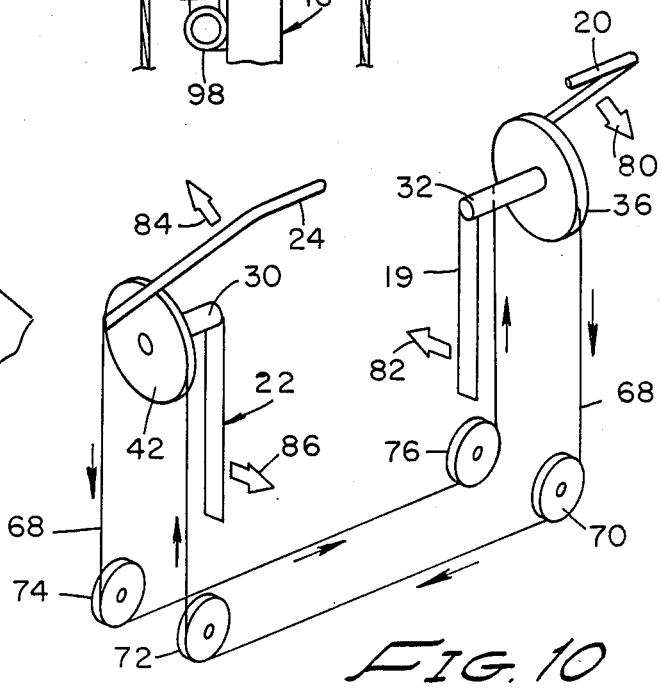
FIG. 10 is a generally schematic view illustrating the operation of the synchronizing pulley system of the apparatus of the invention.

Referring to FIGS. 2 and 10, the synchronizing means of the embodiment of the invention there shown is provided in the form of an endless cable 68 which is entrained over first pulley 36 thence under a first sheave 70, which is rotatably mounted on one side of vertical column 16 proximate the lower extremities thereof, thence transversely of the apparatus and under a third sheave 72 which is mounted on one side of vertical column 18 proximate the lower end thereof, thence over second pulley 42 and downwardly under a fourth sheave 74 which is mounted on the other side of vertical column 18 proximate the lower extremity thereof. Finally, the cable 68 once more extends transversely of the apparatus and under a second sheave 76 which is rotatably mounted on the other side of vertical column 16 proximate the lower end thereof. As is indicated in FIG. 10, when cable 68 is drawn taut, using a turn buckle assembly 69 (FIG. 1), it will operatively interconnect the pulley assemblies 33 and 34 of the apparatus of the invention so that movement of the hand engaging means 20 in the direction of the arrow 80 shown in FIG. 10 coupled with movement of the foot engaging means 19 in the direction of the arrow 82 of FIG. 10 will result in concomitant movement of the hand engaging means 24 in the direction shown in the arrow 84 in FIG. 10 and movement of foot engaging means 22 in the direction of the arrow 86 shown in FIG. 10. With this construction, as the trainee moves the arms and legs in a manner simulating a swimming crawl stroke, the apparatus will ensure a smooth, synchronized exercise movement free from any type of shock or impact stresses. In a manner presently to be discussed, the rotation of at least one of the pulley assemblies can be controllably resisted so that the trainee can work against a predetermined amount of resistive pressure.

The resistance means for providing a resistive load against oscillatory movement of the first hand and foot engaging means and the second hand and foot engaging means is here provided in the form of a hydraulic cylinder mechanism operatively associated with pulley 36. As best seen by referring to FIG. 1, the hydraulic cylinder mechanism of the present embodiment of the invention includes a hydraulic cylinder 90 of conventional construction having a cylinder portion 92, a piston 94 reciprocally movable within cylinder portion 92 and an elongated connecting rod 96 having a first end **96*a* connected to the piston and a second end 96*b* extending from the cylinder portion 92** through an appropriate hydraulic fluid seal means.

Also forming a part of the resistance means of the invention, is a first means for pivotally connecting the cylinder portion 92 of the hydraulic cylinder to one of the vertical uprights, in this case vertical upright 16. As seen by also referring to FIG. 2, this first means comprises a bushing 98 affixed to the lower end of cylinder portion 92. Bushing 98 is adapted to rotatably receive an axle 100 which is carried by a bracket 102 affixed to column 16 by fasteners such a bolts 104.

As indicated in FIGS. 1 and 6, end **96*b* of the connecting rod of the hydraulic cylinder is operatively interconnected with a cross member 106 which is slidably mounted on pulley 36. Cross member 106 is provided with a longitudinally extending slot 107 which closely receives an outwardly extending threaded stud 108. Stud 108 is secured to pulley 36 by means of an internally threaded block 110 which, in turn, is affixed to the pulley wheel by means of threaded fasteners 112 (FIG. 6). An internally threaded knob 114 is threadably receivable over the outwardly extending end of threaded stud 108 and includes a clamping surface 114*a* which can be moved into clamping engagement with the cross member 106. Cross member 106 also carries a outwardly extending connector pin 116 which is receivable within a bushing 118 carried proximate end 96*b* of the connecting rod 96 of the hydraulic cylinder. With the construction thus described, the hydraulic cylinder assembly is pivotally connected at one end via bushing 98, which is affixed to upright 16, and is pivotally connected at its opposite end proximate the extremity 96*b* of the connecting rod 96 with the cross member 106**.

Figure 8:
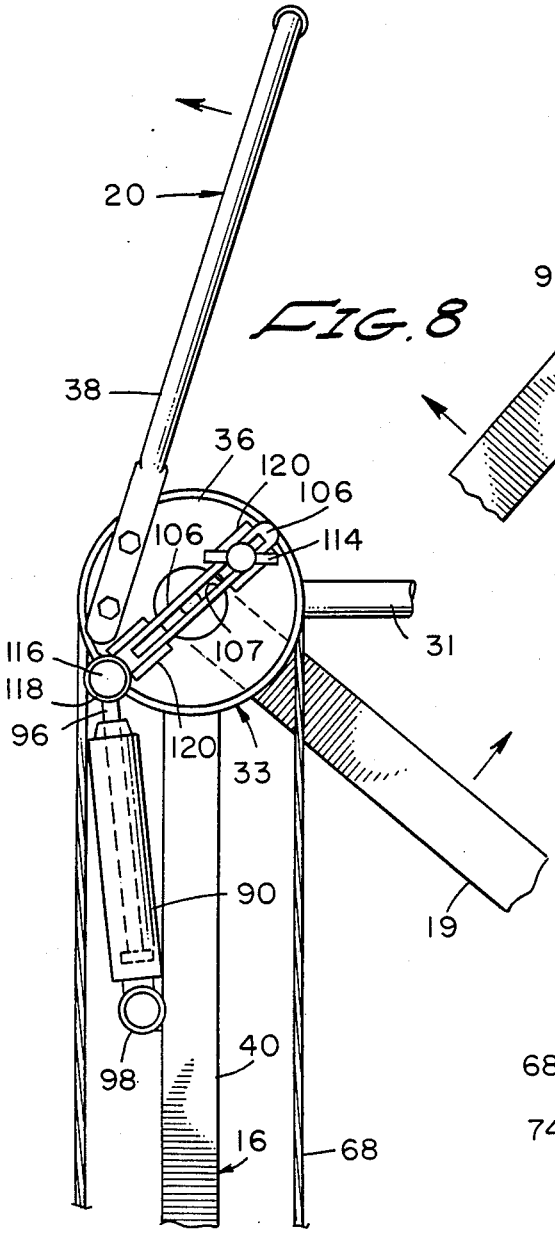
FIG. 8 is a fragmentary side view of the apparatus, similar to FIG. 1 and illustrating the construction of the resistance mechanism of the invention.
Figure 9:
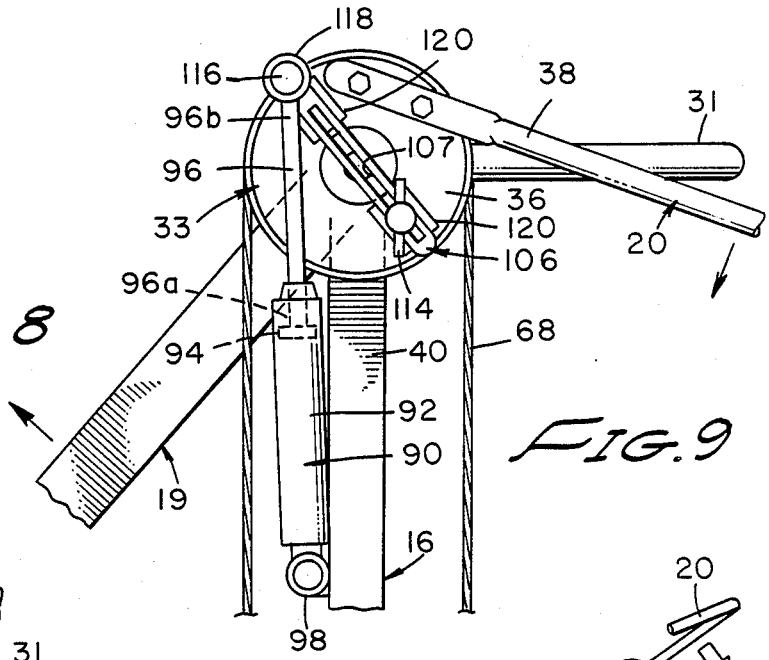
FIG. 9 is a fragmentary, end view similar to FIG. 8 further illustrating the operation of the resistance mechanism of the invention.

Referring to FIGS. 8 and 9, it can be seen that when hand engaging means 20 is in its upraised position shown in FIG. 8, pulley 36 has been rotated to a position wherein the piston 94 of the hydraulic cylinder mechanism is fully extended within cylinder 92. As the hand engaging means 20 is moved into the lowered position shown in FIG. 9, rotation of pulley 36 in a clockwise direction will cause the piston 94 to move upwardly within cylinder 92 against the resistance of the hydraulic fluid contained within cylinder 92. This upward movement of piston 94 within the cylinder 92 imposes a resistance against rotation of the pulley 36 from the position shown in FIG. 8 into the position shown in FIG. 9. This resistance to rotation of the pulley 38 is, of course, reflected in resistance to the movement of the hand engaging means 20 to the lowered position and the simultaneous movement of the foot engaging means 19 into the rearward position shown in FIG. 9. The resistance offered to rotation of pulley 36 is a function of the resistance offered by the hydraulic fluid of the hydraulic cylinder mechanism to the movement of piston 94 reciprocally of cylinder 92. Accordingly, with the component parts of the resistance means located in the manner shown in FIGS. 8 and 9, a calculable degree of resistance is offered by the hydraulic cylinder mechanism to the oscillatory movement of the foot and hand engaging means 19 and 20 respectively. Because pulley 36 is operatively interconnected with pulley 42 by the synchronizing means, including cable 68, this resistance to oscillatory movement of the first hand and foot engaging means is also translated to resistance of movement of the second hand and foot engaging means of the invention.

Figure 7:
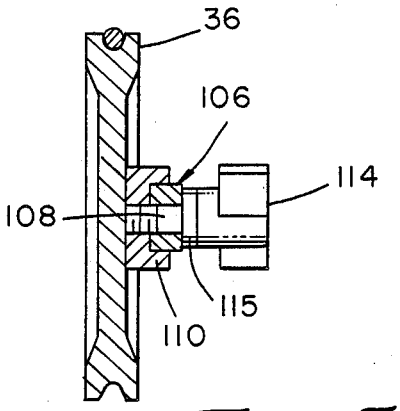
FIG. 7 is a cross-sectional view taken along line 7—7 of FIG. 6.

Turning now to FIGS. 6, 7 and 9, it is to be observed that cross member 106 is slidably received within a pair of channel members 120 which are affixed to pulley 36. By loosening handle 114 so that surface **114*a* thereof is not in pressural engagement with a bearing 115 carried by the cross member 106, the cross member can be slidably moved within channel members 120 from the position shown in FIGS. 8 and 9 into the position shown in FIG. 11. This sliding movement of cross member 106 brings end 96*b* of the connecting rod of the hydraulic cylinder mechanism of the invention radially closer to the center or axis of rotation of pulley 36. It is apparent that as end 96*b* of the connecting rod moves closer to the axis of rotation of the pulley 36 along a radius of the pulley, the resistance offered by the hydraulic cylinder mechanism to rotation of pulley 36** decreases. In this way the effective resistance offered by the hydraulic cylinder mechanism of the invention to movement of the hand and feet engaging means of the invention can be precisely and controllably adjusted.

In using the apparatus of the invention, the user or trainee mounts the apparatus, for example, by placing the right foot into foot engaging assembly 50 and gripping the hand grip portion **38*a* of the hand engaging means 20. If desired, the cross bar 31 can then be gripped with the left hand and the left foot placed into foot engaging assembly 52. The left hand can then be moved into gripping engagement with the hand grip portion 44*a* of the hand engaging means 24**.

With the trainee thus positioned within the apparatus, a force exerted forwardly and downwardly on one hand engaging means and a force exerted rearwardly and upwardly on the other hand engaging means will result in a simultaneous movement of one foot in a forward direction and the other foot in a rearward direction. (See, for example, FIGS. 1, 8 and 9). Continued synchronous movement of the arms and legs in this manner will closely simulate a swimming-like stroke providing exercise to both the upper and lower body. Experience has shown that maximum benefit is obtained when the hand engaging means is arranged to move through an arc of between about 80 degrees and about 100 degrees. Similarly the foot engaging means is preferably arranged to move through an arc of between about 80 degrees and about 120 degrees.

During movement of the arms and legs, rotational movement of pulley 36 will, of course, be resisted by the hydraulic cylinder assembly 90. If a greater resistance is desired the slide 106 is moved to the position shown in FIG. 1. If a lesser resistance is desired the slide 106 is moved to the position shown in FIG. 11.

It is to be understood that the resistance means of the invention could take several forms. For example, resistance to rotation of pulley 36 could be accomplished electromagnetically or by means of a friction disc, flywheel arrangement. Electromagnetic or frictional resistance to rotation of the axles 26 and 28 could also be provided in a manner well known by those skilled in the art.

Turning now to FIGS. 12, 13, 14 and 15, an alternate form of the aerobic exercising apparatus of the present invention is there shown. This form of the apparatus comprises a supporting frame 122 having a base 124 and first and second transversely spaced uprights 126 and 128 (FIG. 13) mounted on base 124. Carried by the supporting frame 122 are first and second foot engaging means and first and second hand engaging means for engagement by the user during the performance of exercises on the apparatus.

As is the case in the earlier described embodiment of the invention, the first foot engaging means, generally designated by the numeral 129, restricts the movement of the right foot of the user to an oscillatory motion along a first arcuate path between a first forward position A and a second rearward position B. The first hand engaging means, generally designated by the numeral 130, restricts the movement of the right hand of the user to an oscillatory motion along a second generally arcuate path between a first upraised position A and a second lowered position B (see the phantom lines of FIG. 12.)

Figure 13:
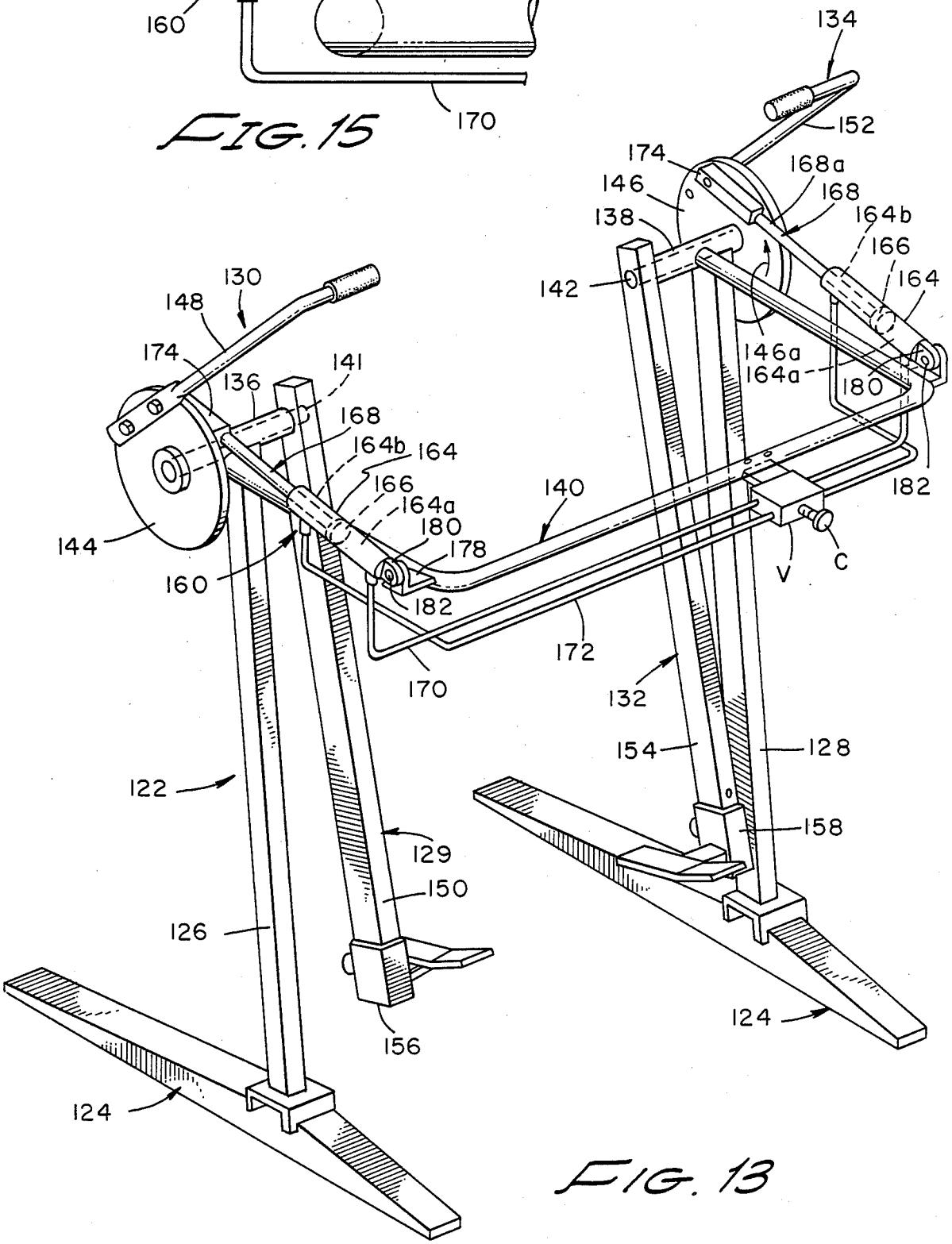
FIG. 13 is a generally perspective view of the apparatus shown in FIG. 12.

The second foot engaging means, generally designated in FIG. 13 by the numeral 132, restricts the movement of the left foot of the user to an oscillatory motion along a third arcuate path between a first forward position and a second rearward position. Similarly, the second hand engaging means, generally designated in FIG. 13 by the numeral 134, restricts the oscillatory movement of the left hand of the user to an oscillatory motion along a fourth generally arcuate path between a first upraised position and a second lowered position. Once again the oscillatory movement of the left hand and left foot is constrained by the apparatus within generally vertically extending substantially parallel planes. These planes are also substantially parallel to the planes of movement of the right hand and right foot of the unit.

Figures 12, 14:
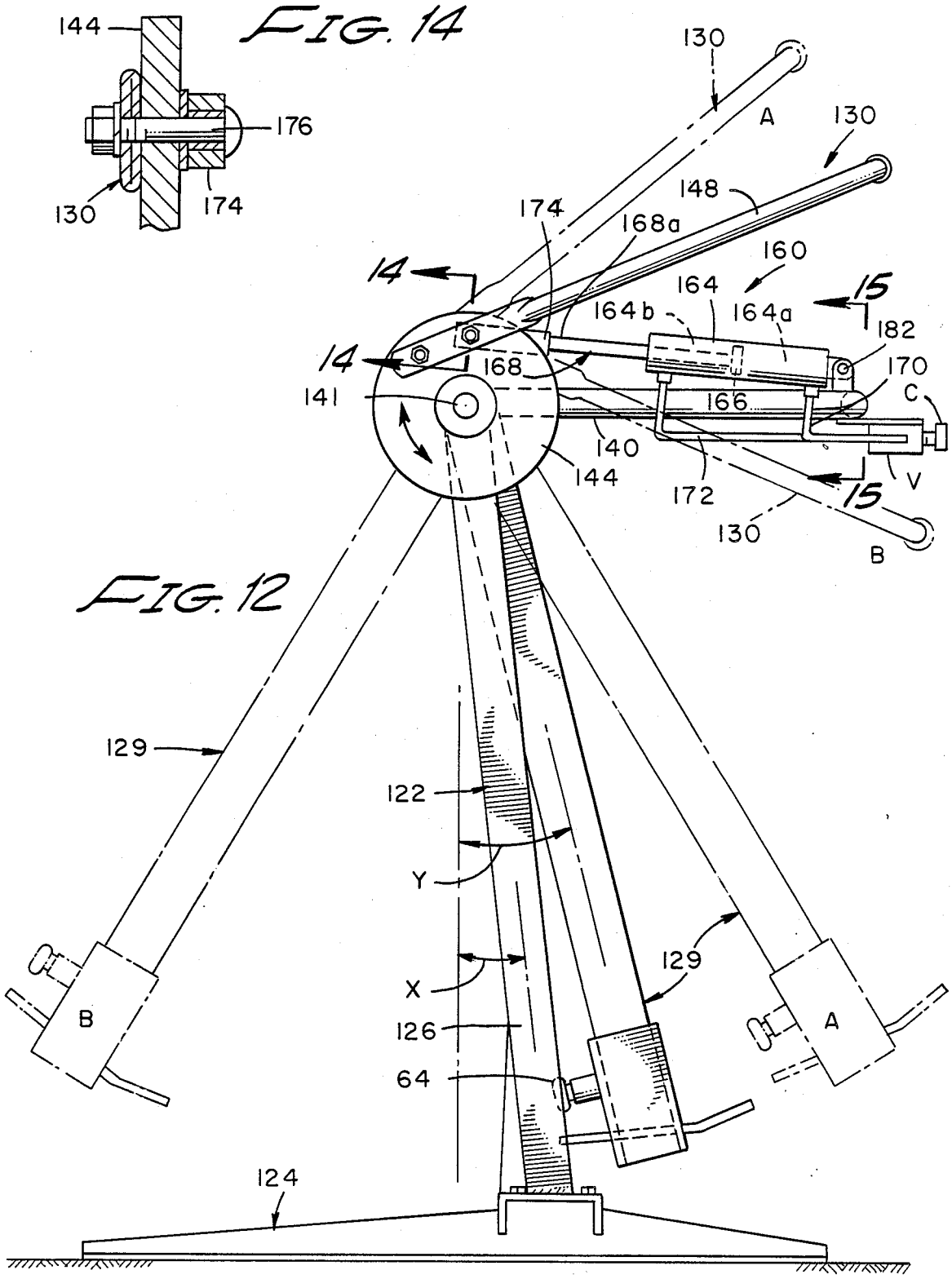
FIG. 12 is an end view of an alternate form of the Aerobic Condition Apparatus of the Invention.
FIG. 14 is a fragmentary cross-sectional view taken along lines 14—14 of FIG. 12.

It is important to note that in the form of the invention shown in FIGS. 12 and 13, the uprights are angularly upwardly inclined at an angle X of about ten degrees with respect to vertical. (FIG. 12)

Bearing assemblies 136 and 138, which are of similar construction to bearing assemblies 30 and 32, are mounted on uprights 126 and 128 respectively proximate the upper ends thereof and in the manner shown in FIG. 13. These bearing assemblies rotatably carry axles 140 and 142. A generally U shaped forwardly extending support bar 140 is interconnected at its ends with bearing assemblies 136 and 138.

Affixed proximate one end of axles 140 and 142 for rotation therewith, are first and second support members 144 and 146. Attached to support member 144 is an elongated upwardly extending member 148 which comprises a part of the previously identified first hand engaging means 130. Affixed at the other end of axle 140 is a downwardly extending member 150. Member 150 forms a part of the previously identified first foot engaging means 129 of the invention.

Attached to the second support member 146 is an elongated upwardly extending member 152 which forms a part of the previously identified second hand engaging means 134 of the invention. Affixed at the other end of axle 142 is a downwardly extending member 154. Member 154 forms a part of the previously identified second foot engaging means 132 of the invention.

Referring particularly to FIG. 13, it is important to note that the first and second foot engaging means of the apparatus are operatively interconnected such that during the performance of exercises using the apparatus members 150 and 154, along with the trainee's first and second feet, move into coplanar alignment in the manner shown in FIG. 13 only within a plane extending angularly of vertical. While this plane can extend at an angle of between about 5 degrees and about 25 degrees, an angle Y of about 15 degrees relative to vertical as indicated in FIG. 12, has been found most desirable to create the proper feel and balance. When members 150 and 154 are in a coplanar relationship, the hand engaging members are preferably disposed at an angle of about 25 degrees above horizontal. One hand engaging member is then preferably movable to a position about 25 degrees below horizontal while the other hand engaging member is preferably movable to a position about 75 degrees above horizontal. At the same time one of the members 150 and 154 is movable to a position about 60 degrees forward of vertical while the other is movable to a position about 40 degrees degrees rearwardly of vertical. Greater and lesser ranges of arculate movement are, of course, possible with the apparatus of the invention.

As best seen in FIG. 13, foot support assembly 156 is adjustably connected to member 150 and a foot support assembly 158 is adjustably connected to member 154. These assemblies are of identical construction to foot support assemblies 50 and 52, as previously described, and operate in an identical fashion. The details of construction and operation of these assemblies will not be repeated here.

Considering now the synchronizing means of the alternate form of the invention as shown in FIGS. 12 and 13. In this embodiment of the invention the synchronizing means is provided in the form of fluid control means generally designated by the numeral 160.

The fluid flow control means 160 includes a pair of hydraulic assemblies, each assembly comprising a hydraulic cylinder 164, a piston 166, reciprocally movable within the hydraulic cylinder, a connecting rod 168, having a first end connected to piston 166 and second end extending from the hydraulic cylinder through an appropriate seal for interconnection with one of the support members 144 or 146. Each of the hydraulic cylinders of the hydraulic assemblies include a cylinder portion containing hydraulic fluid. Each of the cylinder portions is divided into first and second chambers 164*a* and 164*b* with each chamber containing hydraulic fluid. As best seen in FIG. 13, first chambers 164*a* are interconnected by fluid conduit means provided here in the form of a fluid conduit 170. Similarly, second chambers 164*b* are interconnected by fluid conduit means here provided as fluid conduit 172.

Referring also to FIG. 14, the outboard end 168*a*, of the connecting rod 168, is affixed to a connecting sleeve 174, which, in turn, is pivotally connected to member 144 by means of a connector such as bolt 176, which also functions to interconnect hand engaging member 130 with member 144. Connecting rod 168 of the second hydraulic assembly is similarly connected at end 168*a* to member 146 (FIG. 13).

Figure 15:
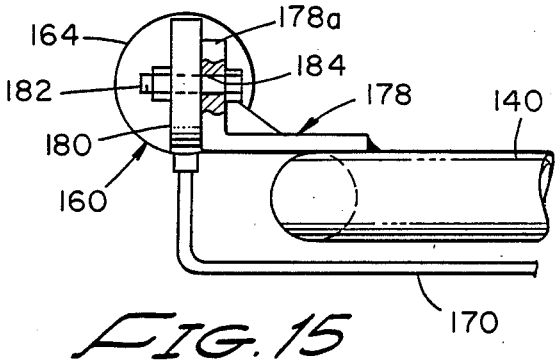
FIG. 15 is a fragmentary view taken along lines 15—15 of FIG. 12.

Referring now to FIG. 15 it is to be observed that hydraulic cylinder 164 is pivotally interconnected with U shaped support bar 140 by means of an angle bracket 178, one leg of which is affixed, as by welding, to U shaped bar 140. One end of each hydraulic cylinder 164 is provided with an apertured ear 180 which is adapted to receive a connector or bolt 182. Bolt 182 extends through ear 180 and through an aperture 184 provided in the upwardly extending leg 178*a* of angle bracket 178.

In operation of the apparatus of the invention shown in FIGS. 13 and 16, a downward force on the first hand engaging means 130 will cause a clock-wise rotation of member 144, which, in turn will cause piston 166 to move to the right within chamber 164*a* of the hydraulic cylinder of the first hydraulic assembly. Fluid within chamber 164*a* will be forced by the piston through conduit 170 into chamber 164*a* of the hydraulic cylinder of the second hydraulic assembly which is interconnected with member 146. Fluid flowing under pressure into this chamber will cause piston 166 and connecting rod 168 to drive member 146 in the direction of the arrow 146*a* (FIG. 13). This, in turn, will force the second hand engaging means 134 angularly upwardly.

As best seen in FIG. 13, downward arcuate movement of member 144 will cause a concomitant rearward arcuate movement of first foot engaging means 129. Similarly, rotation of member 146 in the direction of arrow 146*a* will cause a forward arcuate movement of second foot engaging means 132.

The synchronizing means of the embodiment of the invention shown in FIGS. 12 and 13 and as described in the preceding paragraphs, also uniquely functions as a resistance means for controllably resisting rotation of members 144 and 146. This resistive function is accomplished by operatively interconnecting a fluid flow regulating means within conduits 170 and 172. This means is here provided in the form of a simple fluid flow control valve "V" of a character well known in the art. Valve "V" is provided with a control knob "C" which is interconnected with internal closure members which, upon rotation of the control knob, partially close the fluid flow passageways of conduits 170 and 172. With this arrangement, when the control valve "V" is operated to partially close the flow passageways and thus restrict fluid flow through conduits 170 and 172, greater force is required to be exerted on the hand and foot engaging means of the apparatus to impart rotation to members 144 and 146. Conversely, when valve "V" is to restore free flow of fluid through conduits 170 and 172, less force is required to impart rotation to members 144 and 146.

Figure 17:
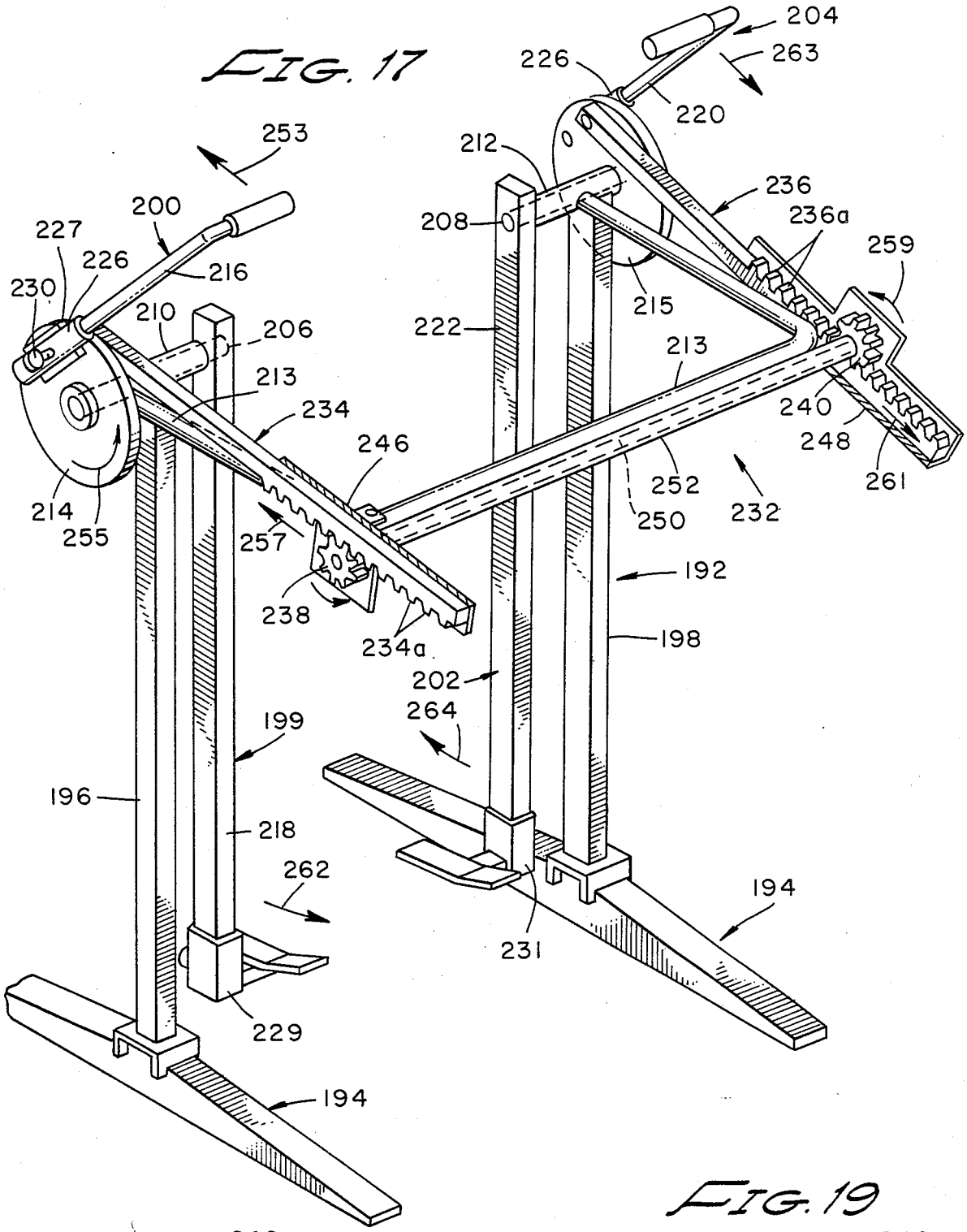
FIG. 17 is a generally perspective view of the apparatus shown in FIG. 16.

Turning to FIGS. 16 and 17 another form of the aerobic exercising apparatus of the present invention is there shown. The apparatus comprises a supporting frame 192 having a base 194 and first and second transversely spaced uprights 196 and 198 (FIG. 17) mounted on base 194. Carried by the supporting frame 192 are first and second foot engaging means and first and second hand engaging means for engagement by the user during the performance of exercises on the apparatus. These means function in a similar manner as those earlier described herein.

The first foot engaging means, generally designated by the numeral 199, restricts the movement of the right foot of the user to an oscillatory motion along a first arcuate path between a first forward position A and a second rearward position B. The first hand engaging means, generally designated by the numeral 200, restricts the movement of the right hand of the user to an oscillatory motion along a second generally arcuate path between a first upraised position A and a second lowered position B (FIG. 16).

The second foot engaging means, generally designated by the numeral 202, restricts the movement of the left foot of the user to an oscillatory motion along a third arcuate path between a first forward position and a second rearward position. Similarly, the second hand engaging means, generally designated by the numeral 204, restricts the oscillatory movement of the left hand of the user to an oscillatory motion along a fourth generally arcuate path between a first upraised position and a second lowered position.

As best seen in FIG. 17, first and second axles 206 and 208 are rotatably carried by first and second bearing assemblies 210 and 212 respectively. Bearing assemblies 210 and 212 are mounted on vertical uprights 196 and 198 respectively proximate the upper ends thereof. Once again a generally U shaped forwardly extending support bar 213 is interconnected at its ends with bearing assemblies 210 and 212. Affixed proximate one end of axles 206 and 208 for rotation therewith, are first and second support members 214 and 215. Member 216, which extends outwardly from support member 214, forms a part of the previously identified first hand engaging means. Affixed at the other end of axle 206 is a downwardly extending member 218. Member 218 forms a part of the previously identified first foot engaging means of the invention.

Member 220, which extends outwardly from support member 215, forms a part of the previously identified second hand engaging means of the invention. Affixed at the other end of axle 208 is a downwardly extending member 222. Member 222 forms a part of the previously identified second foot engaging means of the invention.

In the form of the invention shown in FIGS. 16 and 17, the effective length of first and second hand engaging means is adjustable. Referring also to FIG. 18, it can be seen that a tabular sleeve 226 is affixed to each of the support members 214 and 215 as by welding the sleeves to a plate 227 which is, in turn, welded to the outboard surfaces of the support members. The hand engaging members 216 and 220 are telescopically receivable within the sleeves 226 for movement between a first position fully extended position, as shown in FIG. 16, to a second, foreshortened position wherein the hand engaging members are telescoped inwardly with respect to the sleeves. With this arrangement the apparatus can be readily adjusted for use by the trainee of differing heights and arm lengths.

Threadably receivable within a threaded bore 228 provided intermediate the ends of each sleeve 226, is a thumb screw 230. By tightening the thumb screws the inner ends thereof can be moved into engagement with the hand engaging members 216 and 220 to lock them in a desired telescoped position within sleeves.

A foot support assembly 229 is adjustably connected to member 218 and a foot support assembly 231 is adjustably connected to member 222. These foot support assemblies are of identical construction and operation to those previously described.

Figure 19:
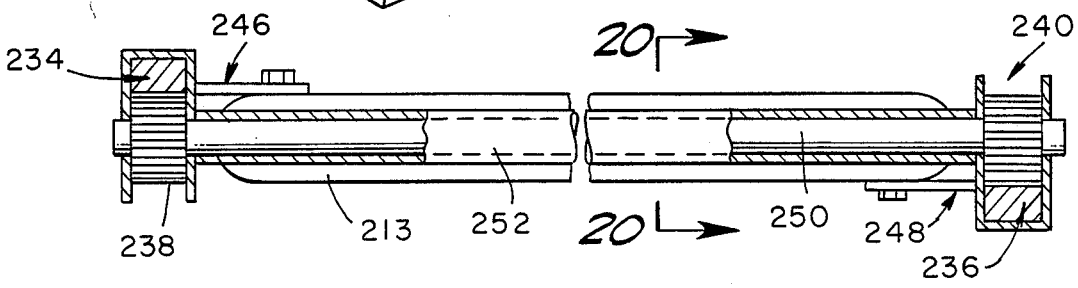
FIG. 19 is a view, partly broken away, taken along lines 19—19 of FIG. 16.

Referring particularly to FIGS. 16 and 17, the synchronizing means of the embodiment of the invention there shown is provided in the form of a mechanical, rack and pinion means generally designated by the numeral 232. Rack and pinion means 232 comprises a pair of toothed racks 234 and 236 and a pair of cooperating pinions 238 and 240. As best seen by referring to FIGS. 17 and 18, rack 234 is connected proximate its inboard end to support member 214 by means of a connector such as a bolt 242 (FIG. 18). Similarly, rack 236 is connected to support member 215 by a connector means such as a bolt 244 (FIG. 18). The opposite, or outboard ends, of racks 234 and 236 extend forwardly of U shaped member 213 in the manner shown in FIG. 17. Referring also to FIG. 19, it can be seen that rack 234 is interconnected with the bight portion of U shaped support bar 213 by means of a connector plate and fastener assembly 246. Similarly, rack 236 is interconnected with the bight portion of U shaped bar 213 by means of a connector plate and fastener assembly 248. It is to be noted that rack 234 is disposed within the apparatus in a manner such that the teeth **234*a*, provided on rack 234, are downwardly depending. Accordingly, connector plate and fastener assembly 246 is connected to the upper surface of the bight portion of the U shaped bar. Rack 236, on the other hand, is disposed within the apparatus in a manner such that the teeth 236*a* formed thereon extend upwardly. In this instance assembly 248 is connected to the lower surface of the bight portion of U shaped bar 213**.

Referring to FIGS. 17, 19 and 20, pinions 238 and 240 are operatively interconnected by an elongated transversely extending shaft 250. Shaft 250 is rotatably carried within a transversely extending sleeve 252, which is interconnected with the bight portion of the U shaped bar 213 as by welding.

In operating the exercise apparatus, of the embodiment of the invention is shown in FIG. 17, an upward force exerted on hand engaging member 216 in the direction of the arrow 253 of FIG. 17, will cause rotation of member 214 in a counterclockwise direction indicated by the arrow 255. Rotation of member 214 will cause rearward movement of rack 234 in the direction of the arrow 257. This in turn will cause counterclockwise rotation of pinion 238 along with shaft 250. Rotation of shaft 250 will cause rotation of pinion 240 in the direction of the arrow 259. This in turn will cause forward movement of rack 236 in the direction of the arrow 261. This movement of rack 236 will impart a rotational movement to support member 215, which will urge hand engaging member 220 to move arcuately downwardly in the direction of the arrow 263. This synchronous rotation of support members 214 and 215 will of course result in synchronous movement of the foot engaging means in the direction of the arrows 262 and 264 of FIG. 19. It is at once apparent that with this mechanical, or rack and pinion means, synchronous movement of the first hand engaging means and first foot engaging means with the second hand engaging means and second foot engaging means is positively effective.

Having now described the invention in detail in accordance with the requirements of the patent statutes, those skilled in this art will have no difficulty in making changes and modifications in the individual parts or their relative assembly in order to meet specific requirements or conditions. Such changes and modification may be made without departing from the scope and spirit of the invention, as set forth in the following claims.

I claim:

1. An aerobic exercising apparatus for use by a trainee in simultaneously exercising the arms and legs comprising:

(a) a base;

(b) first and second transversely spaced frames mounted on said base;

(c) first and second axles carried by said first and second frames for rotation about a substantially horizontal axis;

(d) first and second support assemblies connected to said first and second axles respectively for rotation therewith;

(e) first and second hand engaging means connected to said first and second support assemblies respectively for controlling the movement of each of the hands of the trainee to an oscillatory motion along an arcuate path;

(f) first and second foot engaging means connected to said first and second axles respectively for controlling the movement of each of the feet of the trainee to an oscillatory motion along an arcuate path extending forwardly and rearwardly of said vertical plane;

(g) synchronizing means carried by said first and second frames for causing synchronous movement of said first foot engaging means and said first hand engaging means with said second foot engaging means and said second hand engaging means; and (h) resistance means for yieldably resisting rotation of said first and second axles, said resistance means comprising:

(i) a hydraulic cylinder having a cylinder portion containing a hydraulic fluid, a piston reciprocally movable within said cylinder portion and an elongated connecting rod having a first end connected to said piston and a second end spaced from said cylinder portion;

(ii) first means for pivotally connecting said cylinder portion to one of said first and second frames; and (iii) second means for pivotally connecting said second end of said piston rod with one of said first and second support assemblies, said second means comprising adjusting means for pivotally connecting said second end of said piston rod with one of said first and second support assemblies at selected locations along a radius extending from said horizontal axis of rotation of said first and second axles.

2. An aerobic exercising apparatus for use by a trainee in simultaneously exercising the arms and legs comprising:

(a) a base;

(b) first and second transversely spaced upwardly extending members mounted on said base;

(c) first and second axles carried by said first and second upwardly extending members proximate their upper ends for rotation about a substantially horizontal axis disposed along a line defined by the intersection of a horizontal and vertical plane;

(d) first and second support members connected to said first and second axles respectively for rotation therewith;

(e) first and second hand engaging means connected to said first and second support members respectively for controlling the movement of each of the hands of the trainee to an oscillatory motion along an arcuate path;

(f) first and second foot engaging means connected to said first and second axles respectively for controlling the movement of each of the feet of the trainee to an oscillatory motion along an arcuate path extending forwardly and rearwardly of said vertical plane;

(g) synchronizing means carried by said supporting frame for causing synchronous movement of said first foot engaging means and said first hand engaging means with said second foot engaging means and said second hand engaging means; and (h) resistance means for yieldably resisting rotation of said support members, said resistance means comprising:

(i) a hydraulic cylinder having a cylinder portion containing a hydraulic fluid, a piston reciprocally movable within said cylinder portion and an elongated connecting rod having a first end connected to said piston and a second end spaced from said cylinder portion;

(ii) first means for pivotally connecting said cylinder portion to one of said vertical uprights; and (iii) second means for pivotally connecting said second end of said piston rod with one of said first and second support members, said second means comprising adjusting means for pivotally connecting said second end of said piston rod with one of said first and second support members at selected locations along a radius extending from the center of said support member to the periphery of said support member.

3. An aerobic exercising apparatus, comprising:

(a) a base;

(b) first and second transversely spaced upwardly extending members mounted on said base;

(c) first and second axles rotatably carried by bearings mounted on said first and second vertical uprights proximate their upper ends;

(d) a pulley connected to each of said first and second axles;

(e) an elongated downwardly depending member connected to each said first and second axles, said member having one end spaced from said axle;

(f) a foot support adjustably connected to each of said elongated downwardly depending member proximate said one end thereof, said foot support being movable upwardly and downwardly along each said elongated downwardly depending member;

(g) an elongated outwardly extending member having a first end slidably connected to said pulley and having a second end spaced from said pulley and defining a hand grip portion said member being adjustable between a first position wherein said hand grip is spaced from said pulley by a first distance to a second position wherein said hand grip is spaced from said pulley by a second lesser distance;

(h) first and second sheaves carried by said first vertical upright proximate the lower end thereof;

(i) second and third sheaves carried by said second vertical upright proximate the lower end thereof;

(j) an endless cable entrained over said first pulley, under said first sheave, under said third sheave, over said second pulley, under said fourth sheave and under said second sheave; and (k) resistance means operatively associated with one of said first and second pulleys for yieldably resisting rotation of said pulley, said resistance means comprising:

(i) a hydraulic cylinder having a cylinder portion containing a hydraulic fluid, a piston reciprocally movable within said cylinder portion and an elongated connecting rod having a first end connected to said piston and a second end extending from said cylinder portion;

(ii) first means for pivotally connecting said cylinder portion to one of said vertical uprights; and (iii) second means for pivotally connecting said second end of said piston rod with one of said first and second pulleys at a selected location along a radius of said pulley thereof.

* * * * *